US006874204B2

(12) United States Patent
Dämmig et al.

(10) Patent No.: US 6,874,204 B2
(45) Date of Patent: Apr. 5, 2005

(54) APPARATUS FOR THE OPTIMIZING OF THE REGULATION ADJUSTMENT OF A SPINNING MACHINE AS WELL AS A PROCEDURE CORRESPONDING THERETO

(75) Inventors: Joachim Dämmig, Ingolstadt (DE); Chokri Cherif, Ingolstadt (DE); Imadettin Karalar, Ingolstadt (DE)

(73) Assignee: Rieter Ingolstadt, Ingolstadt (DE)

( * ) Notice: Subject to any disclaimer, the term of this patent is extended or adjusted under 35 U.S.C. 154(b) by 0 days.

(21) Appl. No.: 10/403,819

(22) Filed: Mar. 31, 2003

(65) Prior Publication Data

US 2004/0025303 A1 Feb. 12, 2004

(30) Foreign Application Priority Data

Apr. 2, 2002 (DE) ..... 102 14 649

(51) Int. Cl.[7] ..... D01H 5/00
(52) U.S. Cl. ..... 19/236; 19/239
(58) Field of Search ..... 19/236–240, 150, 19/157; 700/130, 139, 142, 143, 144; 364/470; 395/900, 563, 550

(56) References Cited

U.S. PATENT DOCUMENTS

| | | | | | |
|---|---|---|---|---|---|
| 5,384,934 | A | * | 1/1995 | Dammig | 19/239 |
| 5,583,781 | A | * | 12/1996 | Denz et al. | 700/130 |
| 5,771,542 | A | * | 6/1998 | Dammig | 19/239 |
| 6,088,882 | A | * | 7/2000 | Leifeld | 19/239 |
| 6,157,146 | A | * | 12/2000 | Dammig | 318/6 |
| 6,266,573 | B1 | * | 7/2001 | Promoli | 700/142 |
| 6,457,209 | B1 | * | 10/2002 | Breuer et al. | 19/239 |
| 2002/0023317 | A1 | | 2/2002 | Breuer et al. | |
| 2003/0150266 | A1 | * | 8/2003 | Dammig et al. | |

FOREIGN PATENT DOCUMENTS

| | | |
|---|---|---|
| EP | 0541794 B1 | 5/1993 |
| EP | 0574693 B1 | 12/1993 |
| WO | WO 0012974 A1 | 3/2000 |

OTHER PUBLICATIONS

German Search Report, Aug. 8, 2002.

Excerpts from Rieter's Adaptation to Fiber Type Manual, Oct. 3, 2004.

* cited by examiner

*Primary Examiner*—Gary L. Welch
(74) *Attorney, Agent, or Firm*—Dority & Manning, P.A.

(57) ABSTRACT

The invention concerns an apparatus for the optimization of the regulation adjustment of a machine in spinning preparation, in particular a regulated draw frame, a carding machine, or a combing machine, to which one or more fiber bands are continually fed. The apparatus has at least one sensor which is positioned ahead of the feed end of a draw frame machine for the purpose of capturing the values of band thicknesses of one or more of the entering fiber bands. The apparatus also has at least one delivery end sensor located at the delivery end of the draw frame machine for the purpose of capturing the values of the band thickness of the produced fiber band of a first draw frame operational mode. The apparatus also includes a microprocessor for the comparing of the captured values of the at least one delivery end sensor to those of at least a second draw frame operational mode, whereby the second draw frame operational mode does not represent the normal operational mode of the draw frame machine. The apparatus also includes a control and/or regulation unit for the adaption of the regulatory adjustments on the grounds of such machine characteristics and/or fiber material properties as can influence the measured values. Likewise, a corresponding procedure is proposed.

32 Claims, 3 Drawing Sheets

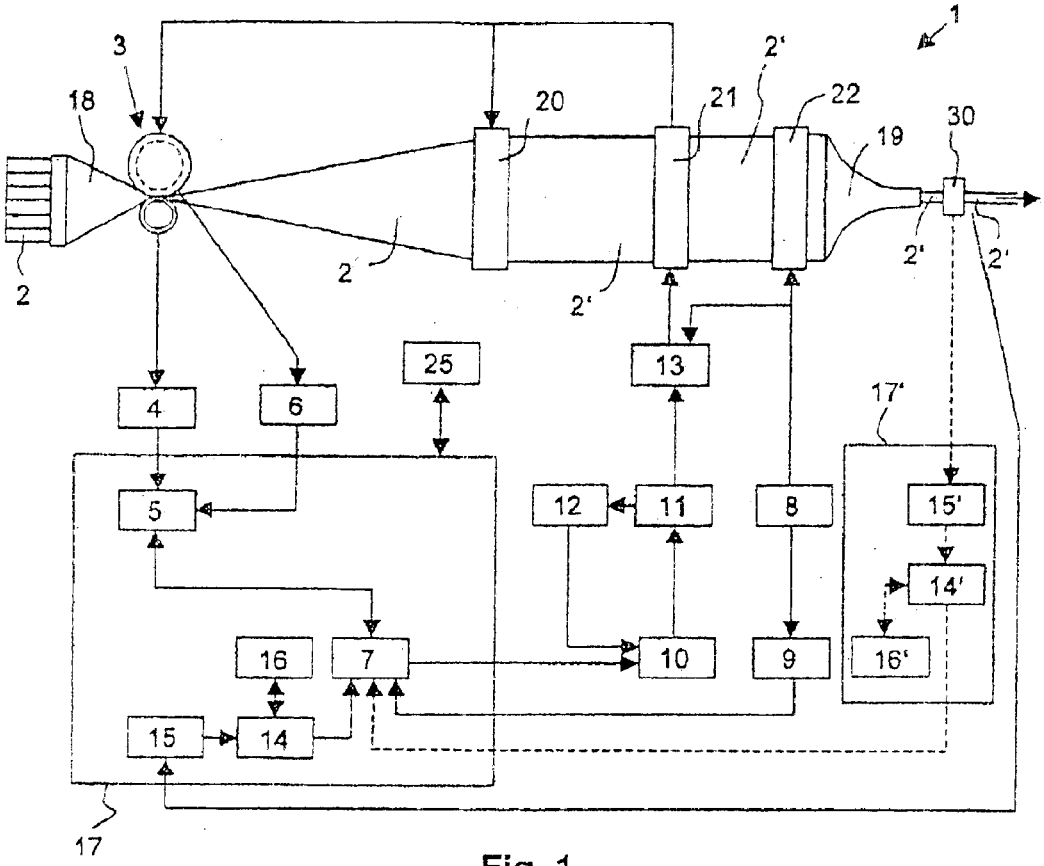
Fig. 1
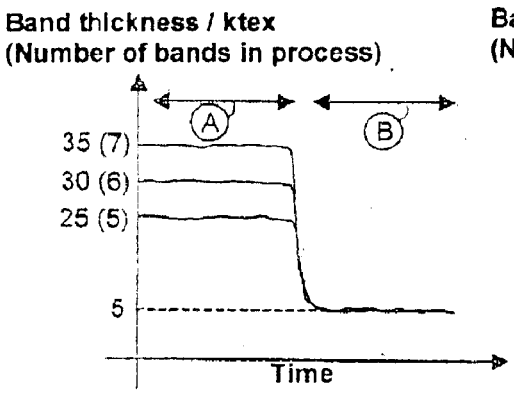
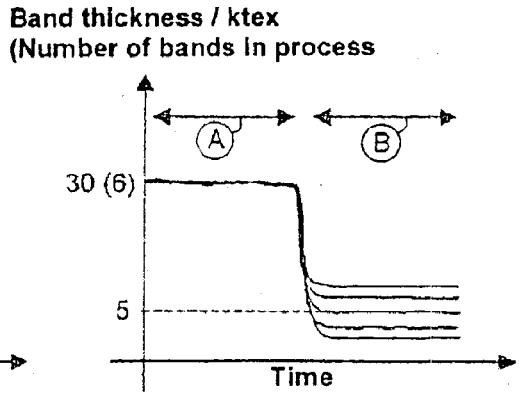
Fig. 2a (State of the technology) Fig. 2b

APPARATUS FOR THE OPTIMIZING OF THE REGULATION ADJUSTMENT OF A SPINNING MACHINE AS WELL AS A PROCEDURE CORRESPONDING THERETO

BACKGROUND OF THE INVENTION

The invention concerns an apparatus for the optimization of the regulation adjustment of a spinning preparation machine with, for example, a draw frame, in particular, a regulated draw frame, a carding machine, or a combing machine. Likewise, the invention concerns first a procedure corresponding to a regulation of said machines and second, a machine for a spinning works.

A spinning preparation machine with a regulated draw frame can be, for example, the regulated draw frame RS-D 30 of the Firm Rieter, wherein the thickness-variations of the entering fiber bands at the feed end are continually monitored by a mechanical device (groove-roll/feeler roll) and subsequently converted into electrical signals. The measured values are transmitted to an electronic memory with a variable, time delayed response. The time delay allows the draft between the mid-roll and the delivery roll of the draw frame to occur exactly at that moment when the band piece, which had been measured by a feeler roll pair, finds itself at a point of draft. The time delay then reacts so that corresponding band pieces can run through the distance between the feeler roll pair and the first location of draft. When the piece of band reaches the hypothetical draft point in the draft field, a corresponding value is released by the electronic memory. The distance, which separates the feeler roll pair and the point of draft, respectively, is called the zero point of regulation. When the zero point is reached, then, conditioned by the value of the measurement, a variable speed motor positioning operation is carried out.

Especially in the case of a change of fiber material, or batches thereof, in regulated draw frames and generally in the case of all spinning machines and universally where textile machines are concerned, extensive re-optimization of the machine regulation is necessary. In the case of draw frames, for instance, the mechanical adjustments must be optimized. These mechanical adjustments include the lengths of the draft fields, the tensioning, the upper roll loadings, the speed of output and the like.

At the same time, the process controlling parameters must be adjusted anew. This adjustment would include the zero point, the intensity of the regulation, (i.e., the amplification of the variable speed motor control), the setting of band fineness, that is, the length related thickness of the band, and the correction values in the case of a slow run of the machine. Actually, sensors measure the band thickness. As a matter of common speech usage, "band fineness" and "band thickness" are employed as synonyms.

A possibility for the determination of at least the optimal regulation intensity is made available by the so-called "bands-test". With this testing, it is expected that inherent machine behavior and material-specific idiosyncrasies would be reliably detected independently of the regulation. The bands-test is carried out in a random sampling manner and executed manually for the determination of the correct control of thickness variation of the fiber band(s). In conducting this testing, first, the normal number of fiber bands present (for instance, six bands) which are being drawn is determined, and at the same time the variations thereof are controlled. Thereafter, one of the bands present is removed, and the remaining bands are subjected to control, so that the required thickness of a band when the normal number of bands are present is achieved. In a converse example, an additional band can be added to the original number of the present fiber bands (in the example, the named 6 bands). The bands are again so controlled, that the band thickness appropriate to the original band number is obtained. From each three steps, samples of a specified length, for instance, of 25 m, are taken out and weighed. (In the speech of the practice, the expression "ktex" is used for the term "band-weight".) This procedural method is repeated a number of times to achieve a statistically secured value. Deviations of the A %-value (A %=percent-based, band thickness deviation) of the drawn, controlled band are determined from the obtained mean values, which represent a three-point measurement. The described bands-test is repeated, until an acceptable A %-deviation (for example, <0.1%) is attained. The procedure and the basis for the calculations as carried out for the draw frame RSB-D 30 of the Firm Rieter are described, for example, in the brief operational manual under Item 2.31, Section 3C/100 to 3C-102.

The bands-test described requires a large investment in time and materials. In the case of the exchange of small batches, such an investment is unwarranted. An additional problem is, that where critical fiber materials are involved, the testing conditions must be held within very exact limits. For example, under certain circumstances of humidity in the working space, fiber material picks up moisture in different quantities, which can falsify the comparativity of the test values. In DE 42 15 682, teaches a method of conducting an automatic bands-test, wherein a transient signal regarding a thickness portion can be directed to an on-line execution of a bands-test. This procedure has, however, the disadvantage, that the regulation fluctuates permanently so that the regulating parameters, especially the regulation zero point and the intensity of regulation, become biased because of the measurements at the output end of the draw frame. In this way, both an interrupted and therefore a not necessarily desired regulation behavior follows which can bring about a chaotic control situation. In an alternative variant of the DE 42 15 682, the transient signal is generated via a reserve band which is infed temporarily, which adds to causing this procedure to also be complex and time consuming.

A further complicated adaption of the parameters for regulation is necessary if the values of the band weight sensors or band thickness sensors at the draw frame feed end, during a specified slow run of the machine (as compared to normal speed, i.e., 800 to 1000 ma/min) must be corrected dependent on the characteristics of the fiber material. In accord with the previously described mechanical feeler-roll system at the entry to the draw frame, it became evident that the feeler roll measurement differs as the speed varies.

Further, the penetrating depth of the feeler roll is dependent upon the kind of fiber, even when thickness does not change. On this very account, previously, with the mentioned Rieter machine, for example, the cited "Adaption to Fiber Type" process is carried out.

Reference can be made, for example, to the brief operational manual for the above mentioned draw frame RSB-D 30 of the firm Rieter under Item 2.30, Section 3C/99. In this reference it is found that the actual band-thickness at the draw frame output end (that is, delivered band thickness) with a slow running machine can be compared with the same delivered band thickness, but processed at a normally fast delivery speed. As part of this comparison, the effect on the band exiting from the draw frame because of weight differentiation was examined. This examination included producing a band sample of, for example, 10 m long at normal operating speed and subsequently, producing the same during a slow run, the latter being perhaps one-sixth of the normal speed. From the result of the weight comparison of the samples, the operating person, having the predetermined standard values ("x % difference between the two actual band-thicknesses somewhat corresponding to a change as referred to in "Adaption to Fiber Type" of y %), can input on an operation panel the correction for measurement error in the values for the slow run of the machine. This procedure is also time consuming, restricts production and is costly.

OBJECTS AND SUMMARY OF THE INVENTION

Thus, it is a principal purpose of the invention to improve an apparatus, that is to say, a procedure of the kind mentioned above, in such a manner that a rapid optimization of regulation parameters of spinning machines and, in particular, of regulated draw frames can be carried out. Additional objects and advantages of the invention will be set forth in part in the following description, or may be obvious from the description, or may be learned through practice of the invention.

This principal purpose is achieved by an apparatus and a procedure performed by the apparatus. The apparatus optimizes the adjustments for regulation of a spinning preparation machine with regulated drawing, in particular, a regulated draw frame machine, a carding machine or a combing machine, which are continuously fed one or more fiber bands. The apparatus has at least one sensor situated ahead of the draw frame for the capture of values of the band thickness of the one or more infeeding fiber band. At least one sensor is located at the delivery end for the determination of the value of the band thickness of the resulting fiber band in a first draw frame operational mode of a draw frame machine. The apparatus has a microprocessor which compares the values captured by the at least one delivery end sensor for the first draw frame operational mode to values for a second draw frame operational mode, whereby the second draw frame operational mode does not represent the normal delivery speed of the draw frame. Using these measured values, a control and/or regulation unit of the apparatus makes adaptions of the regulatory adjustments on the basis of such machine characteristics and/or fiber band material characteristics which can influence such measured values.

The invention offers the advantage of making possible a more rapid optimization of the parameters for the regulation, especially, of the regulation intensity and of the dynamic behavior of the regulated drawing, especially upon change of batch and/or material. At the same time, it becomes possible to quickly detect by computation faulty measured values upon machine start-up and to correct the same by means of the units employed for control and/or regulation. The computing means, i.e., the microprocessor, required for this task can form a separate entity or be integrated, for example, into another central computer station or even be placed in an expanded sensor apparatus.

Advantageously, as a first draw frame operational mode, the normal running of a draw frame will be considered. By means of a comparison of the band thicknesses, or the variance of the band thicknesses, being delivered from the delivery end of the machine (here a draw frame) during the normal operation to those in a second operational mode running at slower operational speed, extrapolation will show to what extent influences inherent in the material and/or the machine will be exerted on the product. If more exact correction is desired, then also third and fourth (etc.) operational modes of the machine can be brought into the evaluation, wherein these third and fourth operational modes are to represent a non-normal operational modes. (The corresponding base value of the normal operation has been obtained in the first operational modes.)

Contrarily, it is also possible, not to designate the first operational mode as being the normal mode of operation, but rather to select a different operational mode from at least a second operational mode, in order to determine optimized regulation in the case of special conditions.

The apparatus in accord with the invention, as well as the corresponding procedure, permits itself to be most advantageously applied, if the at least one sensor at the output end of the draw frame furnishes a very high degree of measuring exactness. Most appropriately, at the output end, would be a nearly ideal measuring sensor, which measures the band thickness and the variations thereof with very little error. The permissible error should not be greater than 0.9%. The parameters for the draw frame can be adjusted very well when based on very exact measured values at the draw frame output end. Especially for such measuring demands, preferably, a microwave sensor (see, for example, WO 00/12974) with a hollow space resonator can be applied at the draw frame output end. In the case of a microwave sensor, the object of measurement is the weight of the band, instead of the thickness of the band. If, in the realm of this invention, where "band thickness" is spoken of, this also includes, in the case of the microwave sensor, the concept of "band weight," which is a measurement of mass per unit of length.

A preferred embodiment of the invention simulates the addition or removal of a single presented band or a principally optional part of one or more presented bands. Therefore, for the optimization of the regulated product, the active, i.e., the actual addition or removal of a single presented band to the actual number of presented bands can be eliminated. The at least one second operational mode simulates the presentation (or removal) of one or more fiber bands or a non-integer number of fiber band parts to the actual present band count, respectively, in an additive or subtractive manner.

The previously stated simulation of the bands-tests has the advantage, that—contrary to the above-mentioned DE 42 15 682 A1—the true band characteristic has no importance. It is not necessary to bring in a transient signal into the presented bands or a reserve band in order to carry out the bands-test. Instead of this, the execution of the simulation at any optional point in time is sufficient.

In the case of such a simulation, control signals advantageously are transmitted to the regulation drive of the draw frame, wherein the electrical voltage of the actual variations of the band thickness—determined from the signals of the at least one sensor located at the feed end of the machine—is increased or decreased in the amount of the voltage corresponding to the simulated additive or subtractive fiber band portions. If, at the same time, it has been simulated that seven bands have been presented to the draw frame when, in reality, only six bands have been introduced, then the corresponding draw frame rolls are controlled as if seven bands were present. The band, which is exiting the draw frame at the output end, accordingly becomes thinner in its cross-section than a normally regulated band—simulation being withheld—wherein the control signal would have corresponded to the true number of bands. If, for example, the set band-thickness should read 5 ktex at six presented bands, then the set band thickness in the case of a simulation of seven presented bands would be 5 ktex x 5/6. If the presentation was simulated at 5 bands, then the set band thickness would be 5 ktex~7/6. The measured actual band thicknesses with the set band thicknesses are now advantageously, by means of iterative changes of the regulation intensity, compensated in such a manner until the actual band thickness essentially agrees with the set band thickness.

This means, that the actual band width deviation is very small. As will be explained below, the actual band width deviation is to be employed as a computational value. In order to proceed in this matter safely, the simulated bands-tests can be repeated correspondingly until a sufficiently exact agreement between the actual and the set values is transmitted to the delivered band thicknesses. In such a case, for example, threshold values may be established, wherein, in an understepping of the same, no further simulations need be undertaken.

With the presented value of the corrected regulation intensity, the characteristic curve of the variable speed motor drive for regulation can be corrected, especially in its slope. Note should be taken that the characteristic curve changes in accord with each adjusted delivery speed on the machine and for each current delivery speed can be computed and stored.

The procedure of the bands-testing is here more explicitly described with the aid of an example.

Upon the presentation of (assumed) several fiber bands, the band thickness deviations as measured by a sensor at the draw frame feed end, designated by $m_i$, which is composed from the mean band weight $m_{doubling}$ and the deviation thereof. $\Delta m_i$ is determined and converted to an electrical signal Ui (which is composed from $U_{doubling}$ and ΔUi). The measurement signal portions, which the dynamic portion ΔUi reflects, are brought in for the regulation. The measurement signal of the mean band weights $m_{doubling}$ represents the so-called 0%-compensation (operational point).

For the simulation of the additives of a presented band, the electrical voltage $U_{doubling}$, which represents the mean band weight, is increased by the direct current amount $\Delta U_{+1\ Band}$ which represents the addition of one fiber band. However, advantageously, this increase can be limited by principally the maximum occurring band thickness deviations, for example, +10%. In case six bands are presented, then the addition of one band would indicate a deviation of band thickness of 16.7%. Upon the limitation of 10%, the presence of a complete band would not be simulated, but rather about 10/16.7 of a fiber band would be simulated.

For the sake of simplicity, however, only an entire band will be considered for the simulation below of the addition (and the subtraction).

In the case of the simulated addition of a band, the regulatory drive signal receives control signals which represent the potential $\Delta U_i$ of the actual band thickness deviations plus the simulated additional direct current amount of $\Delta U_{+1\ Band}$. From this, the result is an actual thinning of the drawn fiber band as compared to the set band thickness by adding a proportional amount of $\Delta U_{+1\ Band}$ the amount of the direct current potential.

For the determination of the percentage-related, actual band thickness deviations ($A\%_{ist}$) in accord with the basis of computation for the bands-test, there are at least two computational methods, independent of each other. The first possibility rests on the formation of a set-quotient, which is derived from the following equation:

$$A\%_{soll} = \frac{T_{soll,\Delta U_{+1Band}}}{T_{N,D}} \cdot 100 \tag{1}$$

For the determination of the actual $A\%_{ist}$ a second equation is put forth:

$$A\%_{ist} = A\%_{soll} - \frac{T_{ist,\Delta U_{+1Band}} - T_{N,D}}{T_{N,D}} \cdot 100 \tag{2}$$

Wherein;

$T_{soll,\Delta U_{+1\ Band}}$: Set band thickness of sim.added band, $T_{ist,\Delta U_{+1\ Band}}$: Actual band thicness of sim.added band, $T_{N,D}$: Actual band thickness of normal drawn bands Advantageously, a plurality of values are determined for the actual band thickness per draw frame operational mode, for example, respectively three values for a fiber band length of 20 m. In the concrete example, this means, that three values for six fiber bands (without simulation) and three values for seven fiber bands (six actually present and one additionally simulated) are measured and thus the arithmetical mean value is determined.

With the aid of Equation (2), it is possible to compute the actual value associated with the A %-value, i.e., $A\%_{ist}$. In this case, this actual value falls above the threshold value. Thus, preferably, the regulating intensity is changed and the simulated bands-test advantageously is carried out again.

Additionally, one or several other band presentations can be simulated, for example, the removal of one band, in order to calculate the appropriate $A\%_{ist}$-value. It is also principally possible to carry out the simulation largely for essentially a second draw frame operational mode (addition or subtraction of a sliver or sliver fraction) and to compare the result advantageously with that of the actual presented fiber bands. Independent of the number of different operational modes on which the measurements were performed, the procedure is preferably iterative. The reason is that the $A\%_{ist}$-value for the at least two draw frame operational modes should be computed and, if necessary, thereafter the regulation intensity changed to calculate the corresponding $A\%_{ist}$-value. This procedure continues until it has understepped a given threshold and the corrected regulation intensity is found.

A second alternative possibility for the calculation of the true $A\%_{ist}$-value rests first, upon the recalculation of the actual band thickness, which has been measured at the delivery end of the draw frame as a result of the simulated addition of one band, namely $T_{ist,\Delta U_{+1\ Band}}$, for the quotient $$\frac{T_{N,D}}{T_{soll,\Delta U_{+1Band}}}:$$

$$T_{ist,\Delta U_{+1Band\ recalculated}} = T_U = T_{ist,\Delta U_{+1Band}} \cdot \frac{T_{N,D,}}{T_{soll,\Delta U_{+1Band}}} \tag{3}$$

The determination of the A %-value is done in accord with the following condensation:

$$A\%_{ist} = \frac{T_U - T_{N,D}}{T_{N,D}} \cdot 100 \quad (4)$$

For the simulation of the removal of a presented band, the electrical potential, that is, $U_{doublng}$, which represents the mean band weight is reduced by the direct current potential amount of $\Delta U_{-1Band}$. In this manner, the regulation drive receives control signals, which represents the signals $\Delta U_i$ of the actual band thickness variations, as well as the simulated direct current potential of $\Delta U_{-1Band}$. From this, the result will be a thickening of the drawn fiber band as compared to the set-band thickness by an amount proportional to the equal potential amount $\Delta U_{-1Band}$, e.g., +10%.

The computation of the actual A %-values, i.e., (A $\%_{ist}$), is carried out advantageously in accord with the equation (2) or (4), wherein the corresponding band thicknesses averaged over a plurality of determined measurements are taken into consideration. In a preferred method, the band thickness is measured by a simulation of an additional fiber band (second draw frame operational mode) and by the band thickness in a simulation of one removed fiber band (third draw frame operational mode) as well as the band thickness being measured in a normal operation (first draw frame operational mode). Advantageously, in this method, the mean values are determined by some three measurements. With the equation (2) at hand, for example, from these (determined) band thicknesses, the A $\%_{ist}$-values are determined respectively for the greater and the lesser number of fiber bands. If these A $\%_{ist}$-values exhibit different prefixes, which is synonymous with an over-regulation in one case and an under-regulation in the other, then a mean value advantageously can be formed. This is also described in the conventional bands-test in regard to the short operational manual under Item 3.31, Sec. 3C/101. The regulation intensity is then preferably changed in iterative processing to the point where this mean value and/or the two A $\%_{ist}$-value understep the specified threshold values.

For the computation of the A %-values, a computer unit is necessary. The execution of the automatic bands-tests by means of simulation is accomplished in a preferred variant before a batch change. Alternatively, or additionally, the simulation bands-test is simulated at definite time intervals and/or following the occurrence of certain happenings, for instance, upon the drift of the A %-value above a specified drift allowance threshold.

In a second advantageous formulation of the invention, erroneous measured values during a slow run of the machine, that is to say, especially during start-up or at shut-down, are corrected. This can occur without the necessity of carrying out the mentioned "Adaption to Fiber Type", which entails extensive laboratory testing. In general, the optimal regulation parameters are not known as a function of the delivery speed below a specified delivery speed. By the use of, for example, a groove-feeler roll pair at the feed end during a slower run of the machine (start-up and stopping the machine), false measurement values are the result because of the differing penetrative behavior of the feeler roll into the individual or collective fiber bands at the slower speeds as compared to the higher production speeds. Only by higher delivery speeds, or in an extreme case, only by reaching the final delivery speed, can one rely on any constancy in the regulation parameters. On this account, when measurements are carried out during the stopping and the starting of the machine, these measurements must be such that they can only be counted on for extrapolation or estimation toward optimal regulation parameters. To this end, measurements with the aid of at least one sensor on the draw frame delivery end are at least necessary at two speeds.

Advantageously, the two speeds are, first, a speed at a defined slow run of the machine (equaling the second draw frame operational mode), for example ⅙ of the operational speed and, second, the higher normal operational speed (equaling the first draw frame operational mode) itself. The presented fiber bands are drafted under regulation at both speeds. The current band thicknesses produced under these conditions are detected by the aid of at the least one sensor at the output of the regulated drawing machine. If necessary, the "Adaption to Fiber Type" operation is automatically activated in such a way that the regulation of the faulty measurement results of the at least one sensor at the draw frame feed end is compensated for by the slow run in comparison to normal operation, i.e., the rapid run. For example, a correction factor which is determined by the processor is also involved here. With this factor, the measurement errors arising in a speed reduced from the normal speed are corrected.

Instead of the two-point measurement, that is, measuring in first, a defined slow run and second, in a normal operational speed, it also becomes possible to employ measured values from many other speeds which have been advantageously reduced from the normal speed. In this way, the precision of the correlation or function between optimal regulation parameters and the delivery speed can be increased. For example, to this end, it is possible that several operational conditions of the draw frame at coming up to speed and/or at shut-down of the textile machine can be employed which offer slower delivery speeds as compared to that of normal operation. The present day speed of the processors makes it possible, during coming up to speed or approaching shut-down, to capture many points of measurement which allow a very exact approach to the functional curve.

The results from the simulated bands-test and the "Adaption to Fiber Type" can be electronically stored to make them available upon a repetition of like conditions. In any case, the simplicity and the rapidity of the invented solution makes such a procedure not unconditionally necessary. In this case, for example, a plausibility control is carried out.

Instead of an automatic adjustment to the optimal regulation parameters, a manual adjustment or correction of this or individual parameters is possible. In this case, these adjustment values are preliminarily proposed by the machine, and the operator can then install the adjustments in a corresponding operations panel, which is advantageously combined with a display apparatus. In another alternative, first, a plausibility monitoring is run through the machine and upon a positive result, the optimization of the regulation parameter(s) is undertaken automatically. In another alternative, after a positive plausibility monitoring, such an optimized machine adjustment is proposed to the operator. The operator can even himself, additionally or alternatively, carry out such a plausibility control on the basis of his own experience and/or with the aid of a control manual.

In the following, the invention is more completely described and explained in greater detail with the aid of the drawing.

BRIEF DESCRIPTION OF THE DRAWINGS

FIG. 1 shows a schematic of circuit arrangement of a regulated drawing machine as well as the regulated drawing machine in accord with the invention;

FIGS. 2*a*, 2*b* show graphs of bands-tests, in 2*a* in accord with the state of the technology and in 2*b* in accord with the invention, wherein respective signals are indicated on an entry sensor and at an output sensor;

DETAILED DESCRIPTION

Figure 3A:
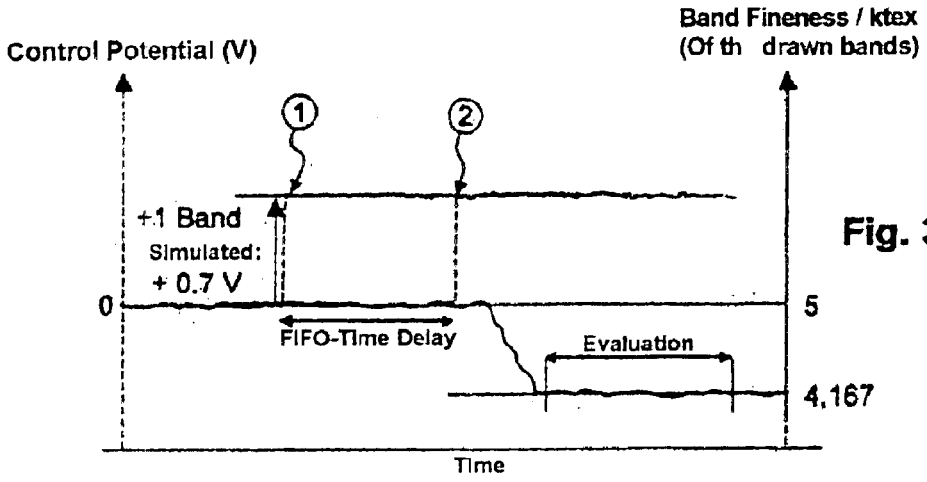
FIGS. 3*a*, 3*b* show graphs of a simulation of an addition to, and a detraction of a fiber band by an appropriate potential, applied in 3*a* at the input of a FIFO storage and, in 3*b*, applied behind the FIFO storage and showing as well the actual band thickness resulting therefrom as measured by an output sensor.

Reference will now be made in detail to the presently preferred embodiments of the invention, one or more examples of which are shown in the figures. Each example is provided to explain the invention, and not as a limitation of the invention. In fact, features illustrated or described in part of one embodiment can be used with another embodiment to yield still a further embodiment. It is intended that the present invention cover such modifications and variations.

Schematically, in the diagram of FIG. 1, is presented the control principle of a regulated draw frame 1 as an example. At the entry to the draw frame 1, the band-thickness of the bands 2 passing through—in this case, six bands 2—are mechanically measured by a groove/feeler roll-pair 3, which is located immediately after a band collection funnel 18. After passing through the funnel 18 and the groove/feeler roll-pair 3, the fiber bands 2 are again permitted to spread out in order to enter the draw frame. The measurement values of the groove/feeler roll-pair 3, which is serving as the fiber feed sensor, are converted in a signal transducer 4 into electrical potential values, which are conducted to a FIFO (First In, First Out) designed memory module 5. This FIFO-memory 5 relays the measurement potentials with the aid of a pulse generator 6, which has a specified time delay to a set value stage 7. The FIFO-memory 5 and the set value stage 7 are a part of a regulation computer 17 (which is shown in a dotted line block). The set value stage 7 gets, in addition to a lead-tachometer 9, a lead potential, which is a measure for the speed of rotation of the lower roll of a delivery roll-pair 22, which roll is driven by a main motor 8. Subsequently, in the set value stage 7, a set potential is computed and transmitted to a control and/or regulation unit 10. In the control and/or regulation unit 10, a comparison is made between the set and actual values. The actual values of concern here originate from a regulator motor 11, which transmits the actual values to an actual value tachometer 12. This tachometer 12, in turn, sends the corresponding actual potential to the control and/or regulation unit 10. The set to actual value comparison made in the control and/or regulation unit 10 is made use of for the purpose of providing the regulation motor 11 with an entirely defined speed of rotation, which corresponds to the desired draft changing speed of rotation. The regulator 11 is connected to a planetary gear drive 13, which receives its drive from the main motor 8. By means of the planetary gear drive 13, the speed of rotation of the lower roll of an feed end roll-pair 20 and the lower roll of a mid-point roll-pair 21 is so altered that a band equalization is established at constant speeds of rotation of the delivery pair 22 (constant delivery speed). The fiber bands on this account are drawn first in the pre-draw section between the input roll-pair 20 and the mid roll-pair 21, and drawn second in the main draw field (and, indeed at the regulation application point) between the mid roll-pair 21 and the delivery roll-pair 22. Also, the groove/feeler roll-pair 3 is driven with the aid of variable speed motors 8, 11.

The band thickness measured at the groove/feeler roll-pair 3 (inlet sensor) serves for the reference regulation band thickness. Because of the fiber band transport from the groove/feeler roll-pair 3 to the draw frame, which comprises the entry, mid and delivery roll pairs 20, 21, 22, a dead time is computed that corresponds to the time delay in the FIFO-memory. The theoretically computed dead time is continually corrected with consideration given to the dynamic drive of the regulation motor 11 and the drive-line belonging thereto. The speed of rotation for the regulation motor 11 as a control value is determined by the control and/or regulation unit 10, which processes the actual band thickness of the fiber band, the set value of the band thickness (as a guide size) and the speeds of rotation of the main motor 8 and the regulator motor 11. By means of the proportional superimposition of the speed of rotation of the main motor 8 and the regulation motor 11, and taking into consideration the computed dead time, the band thickness is regulated in the draw frame at the regulation application point, which lies between the middle roll-pair 21 and the delivery roll-pair 22.

A component, in accord with the invention, of the regulated draw frame, which has been presented as an example, is at least one very precisely measuring band thickness sensor 30 at the delivery end of the draw frame, which, in the shown embodiment (FIG. 1) follows a band funnel 19.

The sensor 30 of this embodiment, for example, can very exactly measure the band thickness variations, which is also the band weight variations of the regulated or processed fiber band 2' leaving the machine by means of microwaves. Other principles of measurement with greater measurement precision are likewise possible, these being based on capacitive, optical, acoustic and/or mechanical measuring methods. The at least one sensor 30, as is shown in an embodiment in FIG. 1, (solid connection line) is connected with the microprocessor 14 in the regulation-computer 17 with the memory 15 interposed therebetween. The microprocessor 14 is in turn connected with the set value stage 7. In a further, alternative—shown in dotted connecting lines in FIG. 1—the sensor 30 is connected to a separate microprocessor 14', with the memory 15' interposing therebetween. This microprocessor 14', itself, can be directly connected to regulation computer 17 whereby the connection continues to the set value stage 7. The microprocessor 14' and the memory 15' can be integrated into a second regulation computer 17' for band monitoring, which is shown again in FIG. 1 by a dotted outline. Alternatively, it is possible to integrate in the at least one sensor 30 itself, a microprocessor with a measured value memory (not shown).

A simulated bands-test is possible by means of the at least one sensor 30. To execute this simulated bands-test, the control and/or computer unit 10 is subjected to a short-period potential. This would be administered through the microcomputer 14 or 14', through the set value stage 7, or through a central computer (not provided in the embodiment of FIG. 1). This potential would represent the addition or the subtraction of one band or a portion of one or several fiber bands presented to the draw frame. These potential signals are superimposed on those of the actual potential signals, which, for example, have been converted in the transducer 4 from the mechanical signals of the groove/feeler roll-pair 3. The control and/or regulation unit 10 provides an adjustment signal corresponding to the superimposed potential signals to the regulation motor 11, so that this exercises a corresponding draft on the fiber bands 2, which are now in the form of spreadout fiber bands.

By means of the at least one sensor 30, which, in accord with the above requirements, permits very precise measurements, the examination can now be made as to whether, and how, the addition or the subtraction of fiber band portions has found its result in the correspondingly regulated fiber band 2'. This evaluation is undertaken in accord with the two presented alternatives in FIG. 1 by means of the microprocessor 14 or 14'. In case the results of the investigation show that the regulation intensity, i.e., the amplification of the regulation motor control, is not optimally adjusted, then these must be changed, preferably on the grounds of the microprocessor findings by means of a corresponding command from the microprocessor 14 or 14' released to the control and/or regulation unit 10. Preferably, subsequent to this, an automatic, that is simulated bands-test, is carried out at least once, in order to determine the proper regulation intensity and, if necessary, the operation is to be repeated (iterated) for further optimization. The intermediate results can be stored in a memory bank, or memory, 16 or 16' and again read out, since the memory is in communication with the microprocessor 14 or 14'. Likewise, in this memory 16 or 16' are stored the different determined factors of the regulation intensity obtained by the possibly different simulated draw frame operational modes. Subsequently, a possibly better evaluated mean or average value is determined from this data advantageously with the aid of the microcomputer 14 or 14'.

Thus, the bands-test, formerly determined by complicated laboratory trials, is simulated by means of the addition or the subtraction of fiber band portions. The simulations would be more precise, that is to say, approached the regulation intensity more closely, if both the addition as well as the subtraction of fiber bands portions were simulated each time more measuring points (simulation of respectively different fiber band parts) were picked up.

Within the framework of the terminology of this invention, "simulated bands-test" modus preferentially designates the normal draw frame mode of operation as the "first draw frame operational mode", and the additional superimposition by means of potential signals of simulated added and/or subtracted fiber band portions as a second, third, fourth, etc. draw frame operational mode. If only one additional or negative potential representing a simulated fiber band part is applied, then, besides the first draw frame operational mode, just a second draw frame operational mode is now to be considered. Advantageously, however, both the addition as well as the removal of a fiber band or a fiber band part are simulated.

In FIGS. 2*a*, 2*b*, respectively, a graph of the previous conventional procedure of the bands-test is displayed in comparison with a graph of a simulated bands-test in accord with the invention. In FIG. 2*a*, one sees an illustration in the left half of the graph of the presentation of six fiber bands 2—which represent the normal operation—as well as the presentation of five to seven actual fiber bands 2 along with the corresponding potential signals generated as measured on the feed end sensor 3 (shown as A). The regulation of the draw frame is so adjusted, that the measured potential signal at the delivery end sensor 30—shown as B in the right half of the graph—and therewith the band thickness of the resulting fiber band 2' is ideally represented as always uniform.

Contrary to this, in the case of the simulated bands-test in accord with the invention as seen in FIG. 2*b*, the actual presented number of the fiber bands 2 is constant, for example, six fiber bands with about 5 ktex, so that even the measurement potential at the inlet sensor 3 oscillates within a narrow range of measurement, namely "A" in the left half of the illustration. Contrarily, with the delivery end sensor 30, different degrees of band thicknesses are obtained corresponding to the actually presented number of fiber bands to which are added or from which are taken the simulated band parts as represented by "B" in the right half of the graph in FIG. 2*b*. The middle measurement curve illustrates the six presented fiber bands 2 without simulation parts. The two upper measurement curves represent a simulation of 10/16.7 or one completely removed fiber band (representing 10% or 16.7% set band weight deviation). The two lower measurement curves represent a simulation of −10/016.7 or one added complete fiber band (representing −10%, or −16.7% set band weight deviation). In toto, in accord with this situation, the simulations must be run through five separate draw frame operational modes, whereby, advantageously, per draw frame operational mode, measurements from several determinations are undertaken. For example, for each draw frame operational mode, measurements are taken three or four times per 20 meters of fiber band and the result determined. The measurement values, corresponding to each measurement are, advantageously, intermediately stored in the memory 15 or 15' and then made available for the determination and further processing employing the microprocessor 14 or 14'.

Figure 3B:
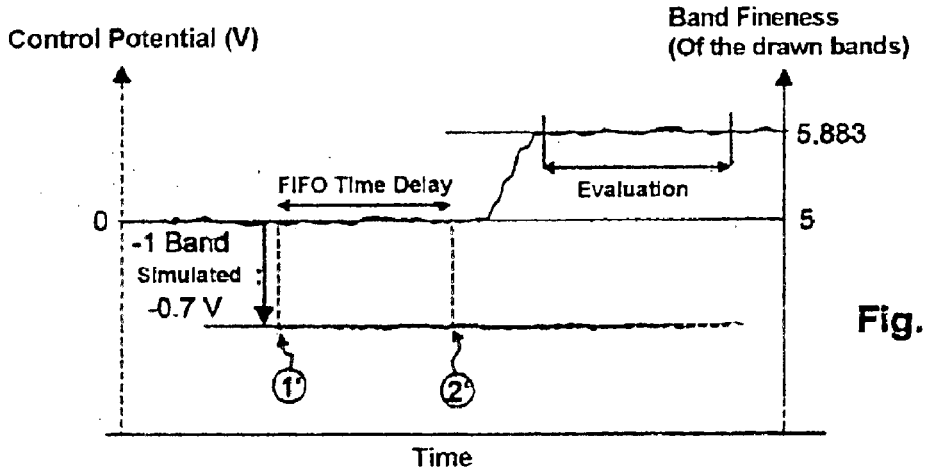

In FIG. 3*a*, the simulated addition- and, in FIG. 3*b*, the simulated subtraction of a fiber band are presented in reference to the actually presented number of fiber bands and, indeed, in respectively two alternatives. The left, dotted Y-axis represents here the predetermined control potential for the variable speed motor 11 and the right, full line Y-axis represents the actual band thickness as measured with the delivery end sensor 30. The control potential runs, in the normal regulation operation, about 0 V (in the case of the—not shown—use of single drives, the control potential would be, in normal operation not equal to 0 V). The graphs pertaining thereto, are likewise plotted respectively in dotted or solid lines. In the case of one of the two alternatives, the fiber band, whether added or removed, can be realized by the superimposition of a corresponding pulse at a potential of about +0.7 V or −0.7 Vat the input of the FIFO memory 5. (See the potential jump at "1".)

Because of the mentioned dead-time, i.e., time delay in the memory 5—this being a "FIFO delay"—the drop-off in the case of a simulated additional fiber band (FIG. 3*a*), and the corresponding rise by a simulated removed fiber band (FIG. 3*b*) only registers with the corresponding delay registered by sensor 30 (covering the distance of the fiber band 2 from the feed end sensor 3 to the regulation onset point, which represents the FIFO-delay plus the covered distance from the regulation point inset point to the delivery end sensor 30).

Otherwise, this is in the case of a possible superimposition of the simulation potential at the output side of the FIFO-memory 5 (or at the input or output of the set value stage 7 or at the input of the control and/or regulation computer 10)—see the respective potential jump at "2"—whereby, because of the short travel between the draw frame and the delivery end sensor 30, the corresponding signal is received with only a short delay at the output of the delivery end sensor 30.

In that particular time delay, which is designated as "evaluation" measuring points were picked up by the sensor 30, for example, one measuring point each centimeter over a band length of 20 m. The determined value provides the set band thickness $T_{ist,\Delta U+1Band}$ or $T_{ist,\Delta U-1Band}$, as appears in Equation (2) (in the section above). As has been explained above, advantageously, because of the spreading of the measurement results, the measurements at each point of operation, that is, each draw frame operational mode, are repeated and subsequently a mean value for the actual band thickness is reprocessed.

Considering now FIG. 4, in the following, with the incorporation of the equations (1) and (2) above, the principle of the simulated bands-test utilizing an example of a six-fold doubling will be described in additional detail. The assumption is made here, that possibly five determined measurements representing five different draw frame operational modes were employed for the establishment of a function, which represents the set band thicknesses, dependent upon the set band thickness deviation ($A\ \%_{soll}$). The actual band thickness of the resulting fiber band 2' by the drawing of six fiber bands 2 without simulation ($T_{N,D}$) should run, ideally, with a presentation of 5 ktex. The set band thickness $A\ \%_{soll}$ resulting from one simulated additional fiber band $Tist,\Delta U_{+1Band}$ calculates out to $5 \cdot 5/6 = 4.167$, so that in accord with Equation (1) $A\ \%_{soll} = -16.7\%$. Following the example of FIG. 4, the removal of one fiber band ($A\ \%_{soll} = 16.7\%$) as well as the addition of one fiber band part representing $A\ \%_{soll} = -10\%$ and the removal of one fiber band part represents $A\ \%_{soll} = 10\%$ is simulated. According to this, in FIG. 4, the curve shows the set band thickness of simulated bands $T_{soll}$ plotted against the set band deviations ($A\ \%_{soll}$).

Figure 4:
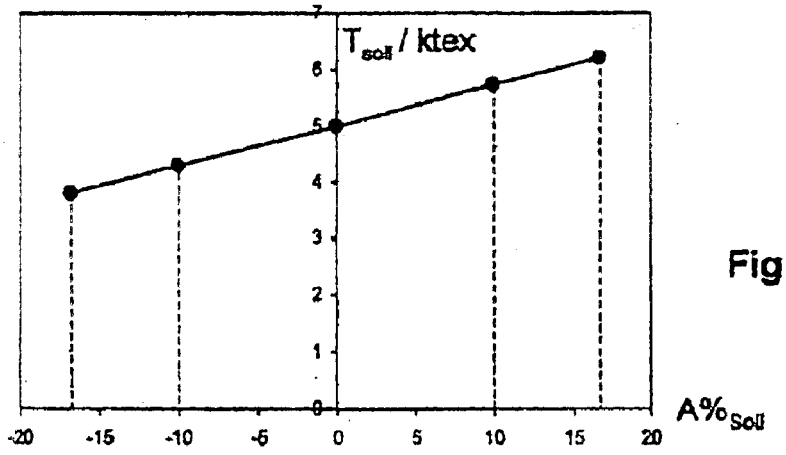
FIG. 4 shows a graph with the set band thickness with and without simulated fiber band pieces, showing dependency of the set band thickness deviation (A $\%_{ist}$)

In principle, now the set band thicknesses of simulated bands $T_{soll}$ in accord with FIG. 4, can be compared with the actual band thicknesses of simulated bands $T_{ist}$ can be compared together as in FIG. 2*b*. From the computational standpoint, with the usage of Equation (2) and the aid of the $A\ \%_{soll}$-value from FIG. 4 for the second, third, etc., draw frame operational mode, a mean value can be computed. Subsequently, the regulation intensity of the draw frame is changed and once again the measurements of the corresponding set-band thicknesses (proportional to the measurement potentials at the delivery end sensor 30) are carried out until the corresponding $A\ \%_{ist}$-value understeps a specified predetermined threshold value.

By means of the invented apparatus, also preferred is a correction of the measurement value error of the feed end sensor 3, in the case of slow delivery speeds, these being possible especially at start-up and shut-down. The first draw frame operational mode represents in this matter the normal operation of the machine with the customary high delivery speeds (these being today in the area of 800 to 1000 n/min), conversely, the second operational mode is operated in a slow run. Especially in the case of mechanically feeling feed end sensors, such as that shown in FIG. 1 as the groove/feeler roll-pair 3, the penetrative depth of the feeling element into the one or more presented fiber bands 2 is dependent upon the speed of these bands, so that measurement error can arise which must be corrected in the slow speed operation.

Figure 5:
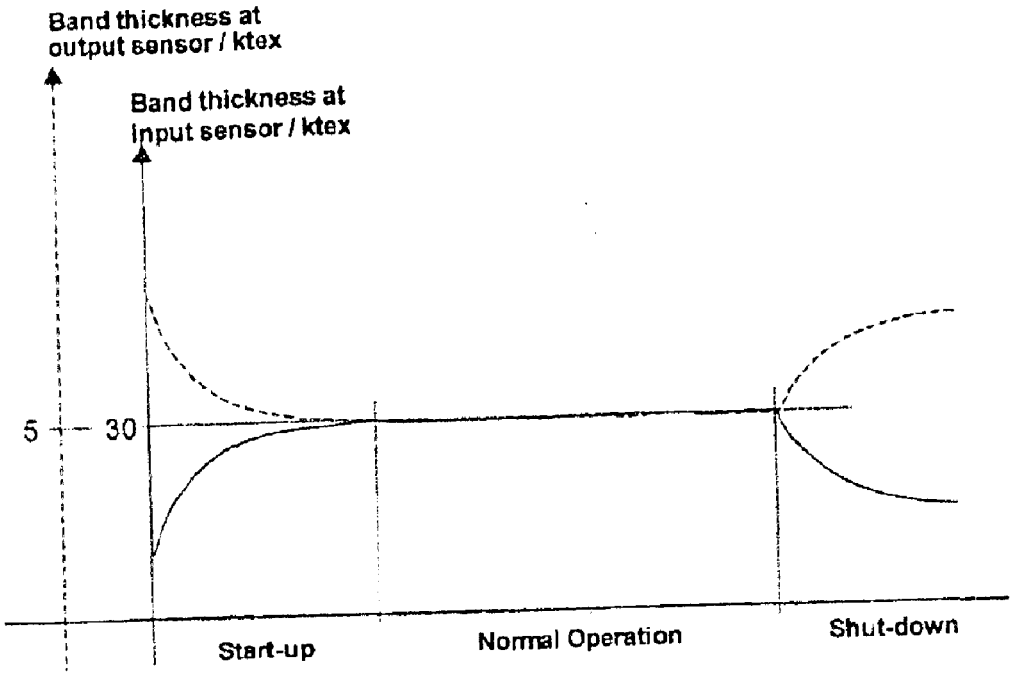
FIG. 5 shows a graph of a presentation of the error to be corrected at the entry sensor during slow delivery speeds.

In FIG. 5, this matter is presented to show greater detail. The band thickness measured at the feed end by sensor 3 (solid line), and the band thickness measured by the sensor 30 at the delivery end (dotted line), are presented for the states of start-up, normal operation, and shut-down of the machine. The whole band thickness of the six presented fiber bands should show a constant 30 ktex, wherein this value is measured during normal operation. Upon the start-up and the shut-down of the machine, the rolls of the groove/feeler roll-pair 3 penetrate deeper into these six bands, so that a lesser measure of band thickness results than is the case during normal operation. This situation shows up as the registration of a thin stretch in the fiber band. Reacting to this, more band material is fed into the draw frame, in order to obtain a uniform fiber band. As a consequence at the delivery end sensor 30, the fiber band is detected to be thicker. The invention allows this error to be corrected without the necessity of laboratory checks.

This correction can be undertaken, in accord with the invention, if one or more draw frame modes are operating slower than the more rapid rate designated as normal mode of operation, the currently produced band thicknesses are detected by the at least one delivery end sensor 30. As an embodiment example, shown in FIG. 6, three measuring points are picked up at different slow delivery speeds, along with one measuring point at the normal high speed at which no measuring error can occur at the feed end sensor 3. Advantageously, in this case, mean values can also be determined by a plurality of measurements under the same circumstances. The dotted line clarifies the course of the curve, wherein, if, at each speed of delivery, measuring points were picked up.

With the aid of the microprocessor 14 or 14', the latter as allowed by the alternate in FIG. 1, the measured values are immediately evaluated, which indicate the deviations of the band thicknesses measured on the delivery end sensor 30 during the various speeds of delivery. By the deviation of the band thicknesses, the so-called "Adaption to Fiber Type", can be automatically undertaken in accord with the invention, in such a manner, that the regulation computer 17 compensates for the erroneous measurement results of the at least one feed-end sensor 3 at the one or more slow run speeds by comparison to the normal operating speed (high speed running), whereby the registered measurements signals are corrected and thus the regulation motor 11 is correspondingly controlled. In this matter, advantageously a correction factor or a correction function is determined, for example, by means of the microprocessor 14 or 14' and therewith the measurement error in the speed operation counter to the normal operation is corrected. The correction factor and/or the correction function can be input into the memory 16 or 16'.

Figure 6:
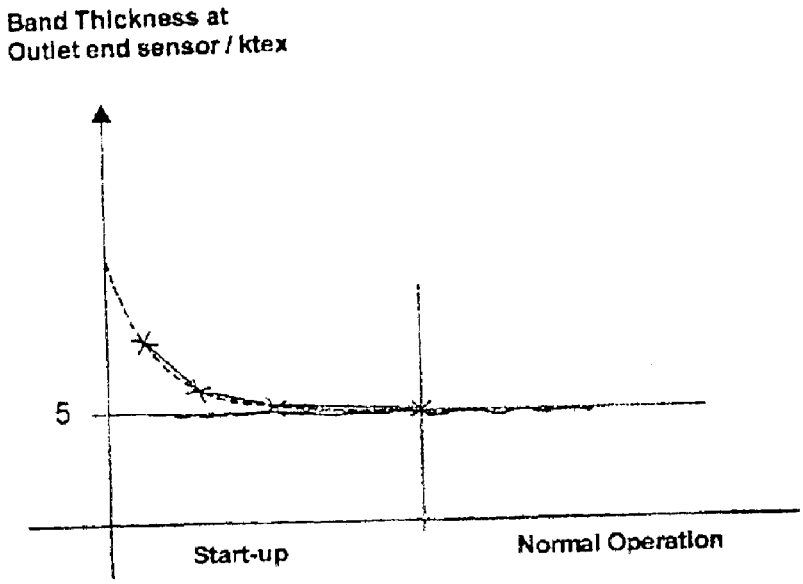
FIG. 6 shows a graph of a correction of the error by means of an automatic "Adaption to Fiber Type."

FIG. 6 shows, for instance, how a correction function of this kind can be determined. The four measuring points are respectively joined by straight lines, wherefrom a non-continuous function arises. The values of the corrections functions upon start-up or upon shut-down of the machine can then be related to the momentary delivery speed in order to accordingly control the regulation motor 11. In a simple alternative, principally just one measurement point at a low speed is taken (corresponding with the state of the technology, in which, in any case, gravimetric laboratory weighing must be carried out on the drawn fiber band) and this measurement point approaches that measurement points at which no measurement error can occur by a single straight line. This straight incremental line then provides a correction factor. Instead of such a linear approximation, it is also possible to combine the measurement point with a constant function, whereby the exactness of the correction can be increased. FIG. 6 likewise shows that the resulting fiber band with the correction in accord with the invention possesses an essentially constant band thickness of 5 ktex (solid line graphing).

With an alternative regulating system (not shown), the planetary gear drive can be dispensed with. In this case predominately, single drives are installed. The drive of the under inlet roll and the under mid-roll is carried out directly by a separate variable speed motor. The exact synchronization of the main motor, which provides the delivery roll with a constant speed of rotation, and the variable speed motor is taken care of by a draft microprocessor. The speed relationship of the two motors determines the draft. Also, in the case of this regulation system, the described invention is accordingly applied.

Before or after the carrying out of each optimizing step, or even at the conclusion of the optimization of the regulation adjustments, the achieved results can be confirmed by the user, for instance, on a machine display such as the display apparatus 25, which, in FIG. 1, is shown connected to the regulation computer 17. The double arrow between the regulation computer 17 and the display apparatus 25 make clear, that, first, data from the regulation computer 17 can be transmitted to the display apparatus 25 and that, second, on the display apparatus 25, for instance, an interface such as a touch keyboard can be placed in order to send commands to the regulation computer 17. In this way, the determined values can be employed by the user, for example, for a plausibility control. As an alternative, the display apparatus and an input apparatus can be installed separate from one another.

After the optimizing, preferably an automatic can exchange at the delivery end could be installed, so that, in the cans, which are subsequently to be filled, only a uniformly drawn fiber band will be laid down, which is optimal over its entire length. Moreover, notice can be exhibited on the machine display that the test material is to be removed.

Thus, the invention makes possible that the bands-test can be considerably automatized. As another advantage, a method for the correction of the band error is proposed, which correction can be effective at the start-up and shut-down of the machine during a defined slow run of a regulated draw frame, as compared to the normal operational speed with consideration given to the fiber material to be processed. As this is done, the processes advantageously can be fully automatic. Especially after a batch change, first the mechanical parameters are optimized and the desired band thickness is obtained, before—advantageously in this succession—the "Adaption to Fiber Type" and the simulated bands-test are undertaken. The point of regulation subsequently can be determined by the CV-value, as this is set forth in the EP 803 596 B1.

The invention has been described in regard to a regulated draw frame. The invention can be used, however, on a carding machine or a combing machine with regulated drawing. Likewise, the invention can be applied to a carding or combing machine with a subsequent drawing machine having regulated drawing.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. An apparatus for optimization of adjustments for a regulated drawing unit for drawing at least one fiber band in a spinning preparation machine, said apparatus comprising:

at least two roll-pairs having said at least one fiber band being receivable by said roll-pairs and said at least one fiber band being drawn between said roll-pairs;

a control unit operably connected to at least one of said roll-pairs, said control unit controlling the speeds of said at least one of said roll-pairs;

a first sensor operably located before said roll-pairs in a direction of travel of said at least one fiber band and in communication with said control unit, said first sensor taking measurements of band thickness of said at least one fiber band before said at least one fiber band is received by said roll-pairs;

a second sensor operably located after said roll-pairs in the direction of travel of said at least one fiber band and in communication with said control unit, said second sensor taking measurements of band thickness of a first resulting fiber band for a first operational mode after said at least one fiber band has been drawn;

a microprocessor operably disposed between said second sensor and said control unit, said microprocessor receiving said measurements of band thickness of said first resulting fiber band for said first operational mode;

a memory in communication with said microprocessor, said memory storing information that includes measurements of band thickness of a prior or subsequent second resulting fiber band for a second operational mode, whereby said second operational mode represents a non-normal operational mode; and said microprocessor making a comparison of said measurements of band thickness of said first resulting fiber band to said measurements of band thickness of said second resulting fiber band and sending said comparison to said control unit, whereby said control unit controls the speed of said at least one of said roll-pairs to regulate said regulated drawing unit by making adjustments based on said comparison.

2. An apparatus as in claim 1, wherein said second operational mode represents a slower speed than said first operational mode.

3. An apparatus as in claim 2, wherein test runs are run to develop at least one of correction factors or correction functions by said microprocessor based on said comparison of said measurements of band thickness of said first resulting fiber band to said measurements of band thickness of said second resulting fiber band and said correction factors and said correction functions are storable in said memory and are usable in regulating said regulated drawing unit.

4. An apparatus as in claim 3, wherein said at least one of correction factors or correction functions are usable to regulate said regulated drawing unit during start-up and shut-down of said spinning preparation machine.

5. An apparatus as in claim 1, wherein said first operational mode includes running at a normal operational speed.

6. An apparatus as in claim 1, wherein said second sensor is a microwave sensor.

7. An apparatus as in claim 1, wherein said second operational mode comprises a simulation, whereby said second resulting fiber band is an actual fiber band produced by said regulated drawing unit operating under said simulated second operational mode.

8. An apparatus as in claim 7, wherein said simulation is performed by said microprocessor.

9. An apparatus as in claim 7, wherein said simulation of said second operational mode is of at least one of an addition or a subtraction of at least part of a fiber band to the at least one fiber band entering said regulated drawing unit to correct a regulation intensity based on said measurements of band thickness of said second resulting fiber band resulting from said simulation.

10. An apparatus as in claim 9, wherein said microprocessor calculates an actual band thickness deviation from said measurements of band thickness of said first resulting fiber band for said first operational mode and said measurements of band thickness of said second resulting fiber band for said simulated second operational mode.

11. An apparatus as in claim 10, wherein said regulation intensity is re-adjusted by at least one of an automatic operation or a manual operation, so that said actual thickness band deviation reaches a minimum value or understeps a specified value.

12. An apparatus as in claim 10, wherein multiple simulations of multiple operational modes are used to create multiple resulting fiber bands with measurements of band thickness of multiple resulting fiber bands being used by said microprocessor to readjust said regulation intensity of said regulated drawing unit, so that said actual thickness band deviation reaches a minimum value or understeps a specified value.

13. An apparatus as in claim 9, wherein said second operational mode comprises potential control signals given to a regulating drive from said control unit which represents the at least one of said addition or said subtraction of at least part of a fiber band to said at least one fiber band entering said regulated drawing unit.

14. An apparatus as in claim 9, wherein said second operational mode comprises potential control signals which represent the at least a part of a fiber band that is to be the at least one of said addition or said subtraction to said at least one fiber band entering said regulated drawing unit, said potential control signals are added or subtracted from an electrical potential signal which represents said measurements of said at least one fiber band measured by said first sensor.

15. An apparatus as in claim 1, wherein said comparison is carried out at predetermined time intervals.

16. An apparatus as in claim 1, wherein said comparison is carried out upon the incidence of predetermined occurrences.

17. An apparatus as in claim 16, wherein said comparison is carried out at a batch change.

18. An apparatus as in claim 1, further comprising a display apparatus operably connected to said control unit and said microprocessor, said display apparatus being capable of displaying information from said microprocessor, said control unit, and said memory.

19. An apparatus as in claim 18, wherein said display apparatus possesses an interface for an operator of said spinning preparation machine to manually enter information.

20. An apparatus as in claim 1, wherein said spinning preparation machine is at least one of a carding machine, a combing machine, or a draw frame.

21. An apparatus as in claim 1, wherein said second operational mode constitutes a slower speed mode than said first operational mode and said first operational mode constitutes running at a normal operational speed.

22. A procedure for optimization of adjustments for a regulated drawing unit for drawing of at least one fiber band in a spinning preparation machine, said procedures comprising the steps of:

feeding at least one fiber band into the regulated drawing unit in a first operational mode;

measuring band thickness of the at least one fiber band using a first sensor as the at least one fiber band enters the regulated drawing unit;

drawing the at least one fiber band into a first resulting fiber band;

measuring band thickness of the first resulting fiber band for the first operational mode using a second sensor as the first resulting fiber band exits the regulated drawing unit;

accessing a memory which includes measurements of band thickness of a prior or subsequent second resulting fiber band for a second operational mode;

comparing measurements of band thickness of the first resulting fiber band for the first operational mode to the measurements of band thickness of the second resulting fiber band for the second operational mode using a microprocessor;

adjusting control of the regulated drawing unit using a control unit based on the comparison of the measurements of band thickness of the first resulting fiber band to the measurements of band thickness of the second resulting fiber band.

23. A procedure as in claim 22, wherein the second operational mode represents a speed which is not a normal operational speed.

24. A procedure as in claim 23, further comprising performing test runs to develop at least one of correction factors or correction functions based on the comparison of the measurements of band thickness of the first resulting fiber band to the measurements of band thickness of the second resulting fiber band, the at least one of correction factors or correction functions being usable to regulate the regulated drawing unit during start-up and shut-down of the regulated drawing unit.

25. A procedure as in claim 22, wherein the second operational mode is a simulation, whereby the second resulting fiber band is an actual fiber band produced by the regulated drawing unit operating under the simulated second operational mode.

26. A procedure as in claim 25, wherein the simulation of the second operational mode is of at least one of an addition and subtraction of at least part of a fiber band to the at least one fiber band being fed to the regulated drawing unit to correct a regulation intensity based on the measurements of band thickness of the second resulting fiber band resulting from the simulation.

27. A procedure as in claim 26, further comprising calculating an actual band thickness deviation from the measurements of band thickness of the first resulting fiber band for the first operational mode and the measurements of band thickness of the second resulting fiber band for the simulated second operational mode.

28. A procedure as in claim 27, further comprising re-adjusting the regulation intensity by at least one of an automatic operation or a manual operation, so that the actual band thickness deviation reaches a minimum value or understeps a specified value.

29. A procedure as in claim 22, wherein the comparison is carried out at predetermined time intervals.

30. A procedure as in claim 22, wherein the comparison is carried out upon the incidence of predetermined occurrences.

31. A procedure as in claim 30, wherein the comparison is carried out after a batch change.

32. A procedure as in claim 22, wherein the second operational mode constitutes a slower speed than the first operational mode and the first operational mode constitutes running at a normal operational speed.

* * * * *